US005186437A

United States Patent [19]

Scott

[11] Patent Number: 5,186,437

[45] Date of Patent: Feb. 16, 1993

[54] POST PULLER INCLUDING CONCRETE BASE PULLING MEANS

[76] Inventor: Ted P. Scott, P.O. Box 232, Fairfield, Calif. 94533

[21] Appl. No.: 660,347

[22] Filed: Feb. 22, 1991

[51] Int. Cl.[5] ..... B66F 3/06

[52] U.S. Cl. ..... 254/30; 254/132

[58] Field of Search ..... 254/29 R, 30, 129, 131, 254/132, 133 R

[56] References Cited

U.S. PATENT DOCUMENTS

| | | | |
|---|---|---|---|
| 654,001 | 7/1900 | Hull | 254/132 |
| 1,427,576 | 8/1922 | Bryant | 254/132 |
| 1,778,682 | 10/1930 | McManus | 254/132 |
| 2,226,456 | 12/1940 | Westendorf | 254/132 |
| 2,777,726 | 1/1957 | Lundgren et al. | 254/30 |
| 5,011,117 | 4/1991 | Youngblood et al. | 254/30 |
| 5,022,632 | 6/1991 | Beideck | 254/132 |

*Primary Examiner*—J. J. Swann
*Attorney, Agent, or Firm*—Harold D. Messner

[57] ABSTRACT

The present invention relates to a post puller for posts of a given cross section that includes concrete bases. The post puller comprises in combination: (i) a fulcrum having a horizontal base, a pair of upright arms extending from the base and a pivot pin of circular cross section attached between the arms remote from the base and perpendicular to the upright arms; (ii) a lever of circular cross section in pivoting contact with the fulcrum as a wooden post is extracted, the lever including a handle of fixed length relative to the fulcrum and a lifting segment, and a perforated plate sized to connect to the wooden post to be extracted for coupling the latter to the handle of the lever. As to item (ii), supra, the perforated plate also connects to a pair of chains of at least three links manipulated such that the center link interlocks with the end links and hence direct lifting force from the lever to the perforated plate and permit lifting of the post away from the earth's surface in concert with the perforated plate.

2 Claims, 5 Drawing Sheets

POST PULLER INCLUDING CONCRETE BASE PULLING MEANS

SCOPE OF THE INVENTION

The present invention relates to a post puller which may be operated in see-saw fashion and more particularly to a post puller in which lever and fulcrum are disconnectably attached in pivotal contact to permit extraction of a post and concrete base and in which one end of the lever is connected to the wooden post to be extracted via post coupling means that can include the following: (i) a perforated plate sized to receive the post connected to the latter by a pair of chains of at least three linkages or (ii) a concrete base pulling means for operation when the post has been broken away from its concrete base via the action of moisture, termites and the like.

BACKGROUND OF THE INVENTION

The prior art is replete with post pullers for removing same from the earth, but few have addressed the particular aspects that the present invention relates, viz., to pull a wooden post of a given cross section even though such posts may be surrounded by unstable ground conditions yet have the capability to also be able to pull broken post stubs encased in concrete from the post hole. That is to say, in pulling wooden posts of a given size, I have found that topography around the post may be extracted, may be sloping, wet and the like which severely limits such post pullers of which I am aware. Those pullers may become inoperative as the fulcrum sinks in wet ground or the weight of the post is too large. In addition, where the post below ground level has been encased in concrete, such posts above the concrete but below ground level, become weak due to the action of moisture, termites and the like. Such post often break during extraction. As far as I am aware, such pullers of the prior art do not have the capability to extract such post stubs while simultaneously be able to pull a full length, continuous post from the ground.

SUMMARY OF THE INVENTION

The present invention relates to a post puller for wooden posts of a given cross section, comprising a fulcrum having a horizontal base, a pair of upright arms extending from the base and an attachable pivot pin of circular cross section attached between the arms remote from the base and perpendicular to the upright arms;

a lever of circular cross section for added strength in pivoting contact with the fulcrum, the lever including a handle of fixed length relative to the fulcrum, a lifting segment, a central pivoting means between the handle and lifting segment, and coupling means connected to the wooden post to be extracted for coupling the latter to the lifting segment of the lever;

said coupling means including one of (i) a perforated plate sized to receive the post connected to the latter by a pair of chains of at least three links manipulated such that the center link interlocks with the end links and hence direct lifting force from the lever to the perforated plate and permit lifting of the post away from the earth's surface and (ii) a choker chain in loopable contact about the concrete base of the post and including end links in gravity contact with the lifting segment of the lever whereby lifting force from the lever can be transmitted to the choker chain to permit lifting of the concrete base away from the earth's surface.

DETAILED DESCRIPTION OF AN PREFERRED EMBODIMENT OF THE INVENTION

Figure 1:
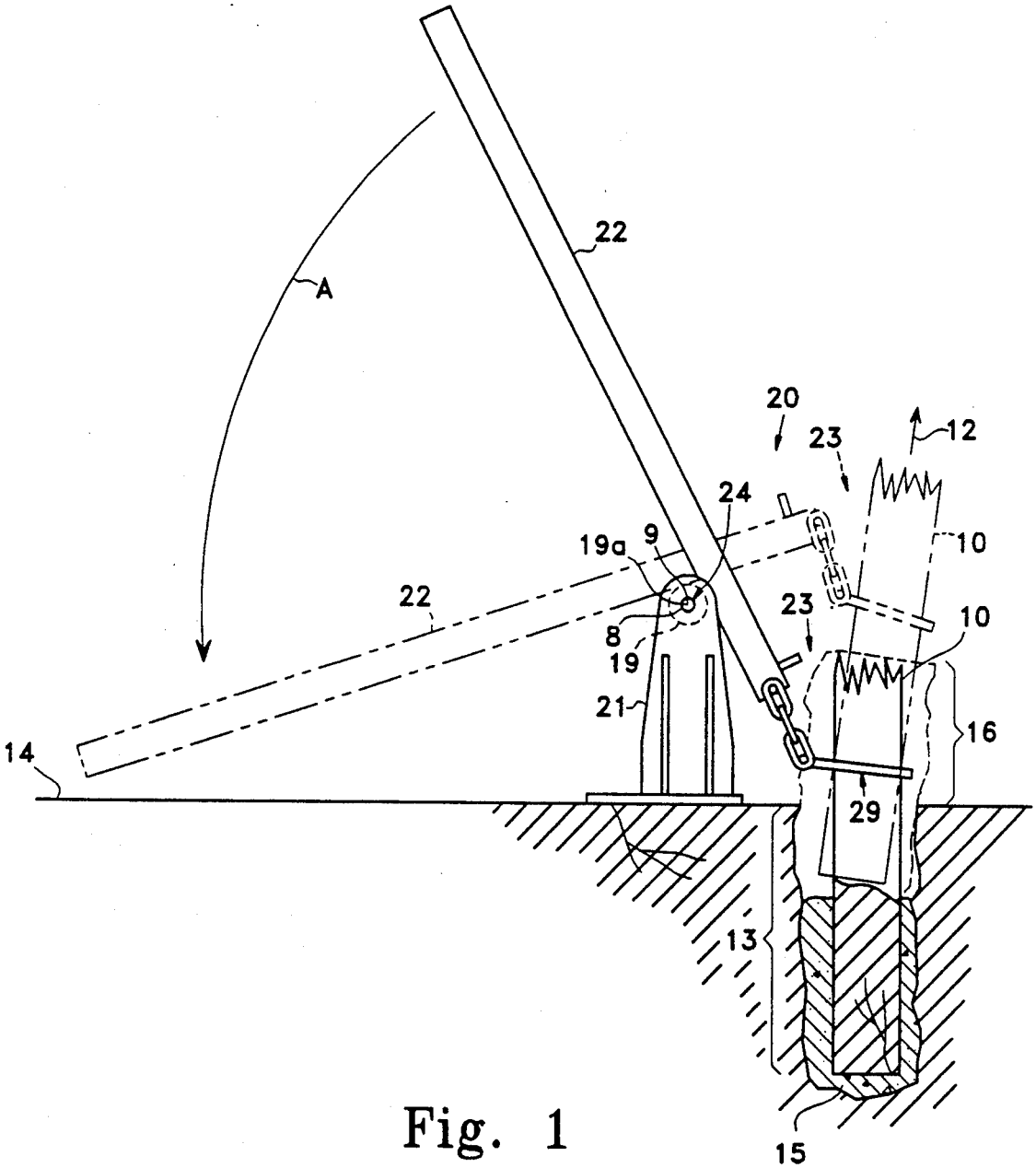
FIG. 1 is a side elevation of a wooden post, in partial section, undergoing extraction using the post puller of the invention at the earth's surface in which a fulcrum of the post puller is positioned at the earth's surface adjacent to the post to be extracted with a lever being pivotally attached to the fulcrum and including coupling means to permit operation in a see-saw manner wherein the final extraction position is in phantom line.

FIG. 1 shows a wooden post 10 undergoing extraction from a hole 11 in the direction of arrow 12. The post 10 is wooden having a uniform size say of rectangular cross section. It includes a base 13 below the earth's surface 14, a segment of which is encased within concrete 15, and above ground segment 16 attached to post puller 20 of the invention.

Post puller 20 includes a fulcrum 21 positioned at the earth's surface 14, a lever 22 of circular cross section for added strength and coupling means generally indicated at 23 for coupling the post 10 to the lever 22. The lever 22 pivotally contacts the fulcrum 21 as explained in more detail below, at a pivot hinge 24 including pivot pin 8 defining an axis of rotation 9. The movement of the lever 22 is from an initial near vertical position show in solid line to a near horizontal position in phantom line in the direction of arrow A. Such see-saw motion is transformed into vertical lifting motion to the post 10 via coupling means 23 irrespective of the weight of the post 10.

Figure 3:
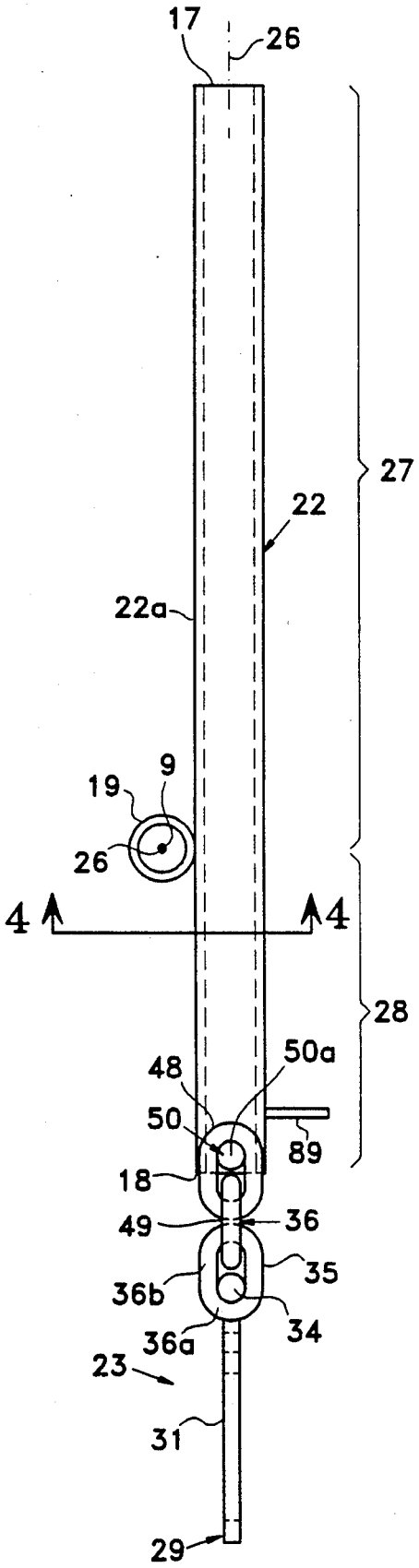
FIGS. 2, 3 and 4 are detail plan, side and sectional views of the lever and coupling means of FIG. 1, the latter being taken along line 4—4 of FIG. 3 and illustrating, inter alia, a pair of chains and perforated plate of the coupling means of FIG. 1 illustrating how the center link of each chain interlocks with the end links and hence directs lifting force from the lever to the perforated plate and permit lifting of the post away from the earth's surface.
Figure 2:
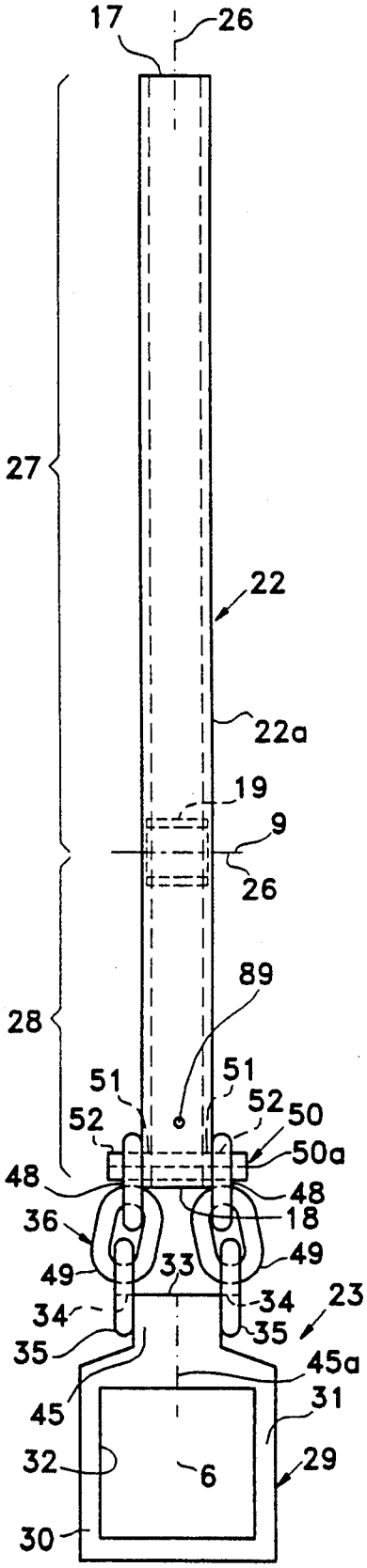
Figure 4:
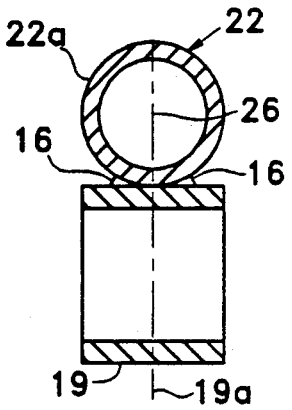

FIGS. 2, 3 and 4 illustrate lever 22 and coupling means 23 in more detail.

As shown, the lever 22 includes a handle 27 and lifting segment 28 of circular cross section defining an axis of symmetry 26 as well as having ends 17 and 18 each a fixed length relative to pivot pipe 19 attached to the fulcrum 21 of FIG. 1. Note that the pivot pipe or beam 19 is cylindrical and attaches to the lever 22 at outer surface 22*a* by welding at welds 16 (see FIG. 4) and defines an axis of symmetry 19*a* transverse to axis 26 of lever 22. The pivot pipe or beam 19 is preferably formed of the same shape and diameter pipe as used to form the lever 22 to maximize strength.

Figure 13:
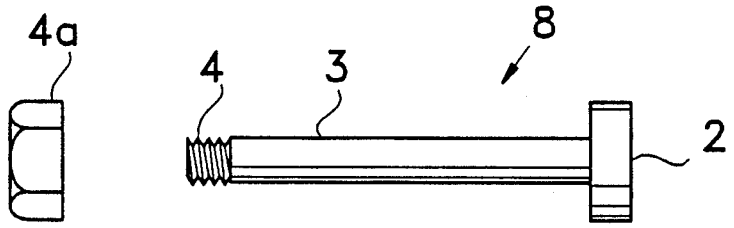
FIG. 13 is a side elevation of the pivot pin for attachment of the lever relative to the fulcrum of the invention.

In operations as shown in FIG. 1, the pipe 19 first is attached to the fulcrum 21 via pivot pin 8 (see FIG. 1) passing interior of the pivot pipe 19 attached to the lever 22 thereby forming the hinge 24 of the invention. In that way, the axis of symmetry 19*a* of the pivot pipe 19 is coincident with the axis of rotation 9 of the hinge pin 8, as previously mentioned. But the diameter of the pivot pin 8 is less than the inside diameter of the pivot pipe 19 so that latter can pivot about axis of rotation 9. FIG. 13 shows the pivot pin 8 in more detail. As shown, pivot pin 8 includes an enlarged head 2, a central portion 3 and a threaded segment 4 to be secured to nut 4*a*.

Returning to FIGS. 2 and 3, attached to the end 18 of the lifting segment 28 is coupling means 23. The coupling means 23 comprises a plate 29 of generally rectangular cross section perforated over a central region 31 to form a rectangular, square or circular opening 32. The opening 32 shown is square in cross section and is sized to receive the post 10 of FIG. 1. At a near end 33 of the plate 31, there is provided ears 34 welded to end links 35 of a pair of chains 36.

Figure 5:
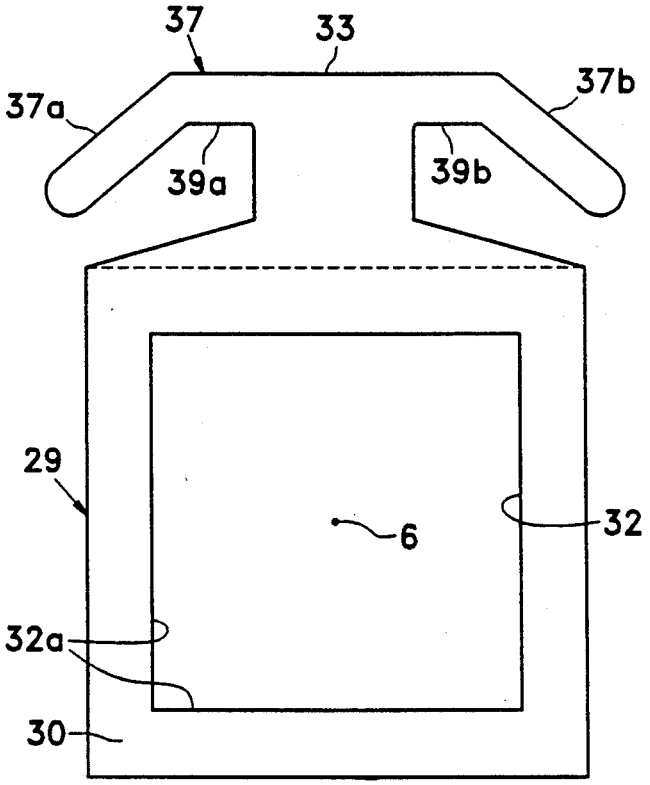
FIG. 5 is a detail plan view of the perforated plate modified to provide wing-shaped attaching means for connection to the lever of FIGS. 2 and 3.
Figure 6:
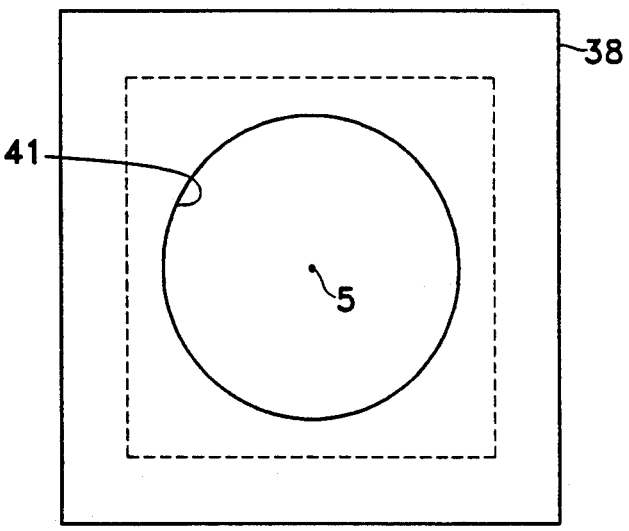
FIGS. 6 and 7 are plan and side views of an insert for the perforated plate of FIG. 5 to extend operation of the latter to different shapes and sizes of posts.
Figure 7:
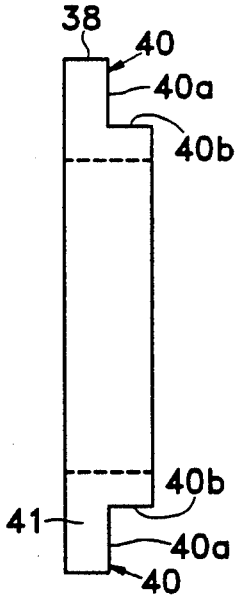

FIGS. 5, 6 and 7 illustrate modifications of the following: plate 29 to include wing-shaped attaching ears 37 (FIG. 5) at end 33 as well as an insert 38 (FIGS. 6 and 7) for causing other shapes of posts 10 to be easily extractable.

In FIG. 5, note that the ears 37 include diverging L-shaped and reverse imaged legs 37*a*, 37*b* dimensioned to slideably receive the end links 35 of the chains 36 of FIGS. 2 and 3. Since the fit of the legs 37*a*, 37*b* and links 35 are such that once the latter are positioned at rest segment 39*a*, 39*b* further movement is prevented, welding of these elements is unnecessary.

In FIGS. 6 and 7, the insert 38 permits posts 10 of FIG. 1 even though of smaller or of a different cross section than that shown, to be extracted. In this regard, note that insert 38 is constructed to be received within the central opening 32 of the plate 29 of FIG. 5 and includes notches 40 in side walls 41 (FIG. 7) to provide attachment relative to the plate 29 in the following manner: (i) via gravity between surface 40*a* of the notch 40 and broad surface 30 of the plate 32, the latter defining a plane normal to axis of symmetry 6 of the opening 32 and (ii) via friction at surface 40*b*. That is, the surface 40*a* is placed in contact with the broad upper surface 30 of the plate 29 during operations while surface 40*b* is in edge contact with side surfaces 32*a* defining the opening 32 of the plate 29. The insert 38 includes an opening 41 of circular cross section in its center having an axis of symmetry 5 (see FIG. 6) coincident with axis 6 of the opening 32. The shape and size of the opening 41 of the insert 38 can easily be changed on accommodate other sizes and shapes of the posts 10 as such are encountered in the field.

Returning to FIGS. 2 and 3, note that near end 33 of the plate 31, there is provided an swedged handle 45. The handle 45 is seen to support the ears 34 by which the end links 35 of the pair of chains 36 are attached relative to the lever 22, as by welding, wherein a plane through the shorter and longer sides 36*a*, 36*b* of the end links 35 are substantially normal to the end 33 of the handle 45. But more remote shorter sides 36*a* extend well beyond the end 33. The handle 45 also has an axis of symmetry coincident with axis of symmetry 26 of lever 22, the latter also being transverse to axis 6 of the central opening 32. The handle 45 also has sides of reduced length as compared to that those of the central region 31 of the plate 29.

At the other end of the chains 36 are end links 48 and central links 49.

Such end links 48 are permanently attached to the lifting segment 28 of the lever 22 via a pin 50 inserted through and rotatable within openings 51, see FIG. 2. More particularly, the end links 48 are first welded to the end portions 52 of the pin 50, such end portions extending beyond the circumference of the lever 22 at diametrically spaced apart locations. In turn, the end links 48 and central links 49 connect to the end links 35 thereby—together—they form the pair of chains 36 previously mentioned.

Note that while end links 35, 48 are permanently attached to support elements by welding, as previously described, center links 49 are permitted to undergo movement relative thereto due to the fact that pin 50 can rotate with respect to openings 51 within the lever 22. But since they are also canted as shown in FIG. 2 relative to the axis of symmetry 45*a* of the handle 45, such movement is limited. But note since the pin 50 is permitted to be rotated relative to the lifting segment 28 of the lever 22 about axis of rotation 50*a*. In that way, the links 35, 48, 49 can be interlocked such that they pass any levering force from the lever 22 directly to the perforated plate 29 to permit lifting of the post 10. Note in this regard that the axis of rotation 50*a* of the pin 50 is parallel to and coextensive with the axis of rotation 9 of the hinge of the lever 22 (coincident with the axis of symmetry 26 of the pivot pipe 19) relative to the fulcrum 21.

Figure 8:
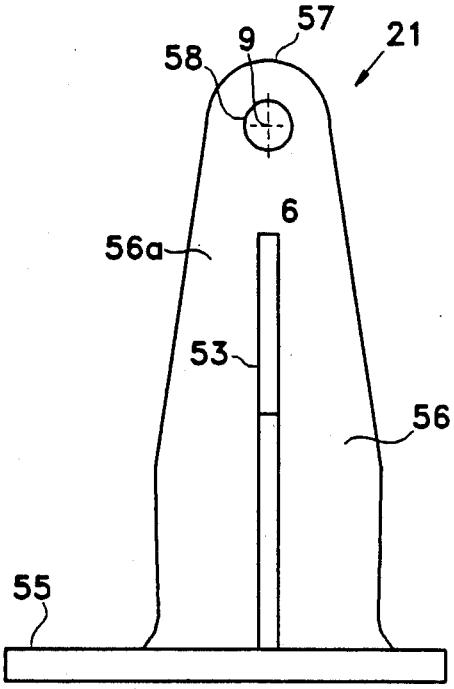
FIGS. 8 and 9 are detail front and plan views of the fulcrum of the puller of FIG. 1.
Figure 9:
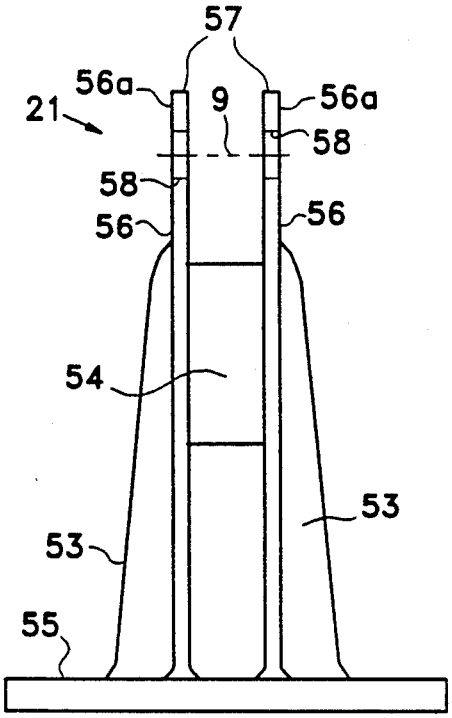

FIGS. 8 and 9 illustrate fulcrum 21 in more detail.

As shown, the fulcrum 21 includes horizontal base 55 and a pair of upright arms 56. Adjacent to end 57 of the arms 56 remote from the base 55 are aligned openings 58 into which pivot pin 8 (FIGS. 1 and 13) extends to attach the lever 22 relative thereto. The upright arms 56 are also provided with transverse legs 53 and central gusset 54 to add strength. The base 55 is rectangularly shaped and of sufficient dimensions so that it does not sink into wet ground during operations.

Note that aligned openings 58 define the axis of rotation 9 (see FIG. 1) when the pin 8 is permanently attached at exterior broad surfaces 56*a* of the arms 56 by the fact that the enlarged head 2 of the pin 8 (see FIG. 13) and nut 4*a* are larger in diameter than the openings 58. The axis of rotation 9 is perpendicular to the upright arms 56. Between the arms 56 in the vicinity of the openings 58 a pocket 52 is formed which restricts movement of the lever 22 to the required see-saw movement when the lever 22 is attached to the fulcrum 21. But note the capability of the coupling means 23 to elongate relative to the fulcrum 21 and post 10 allows the invention to compensate for changes in topography adjacent to the post 10.

Figure 10:
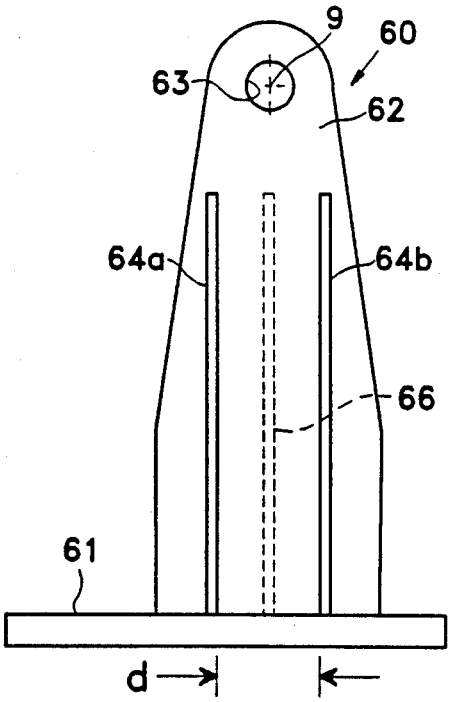
FIGS. 10 and 11 are detail front and plan views of an alternative fulcrum for use in the puller of FIG. 1.
Figure 11:
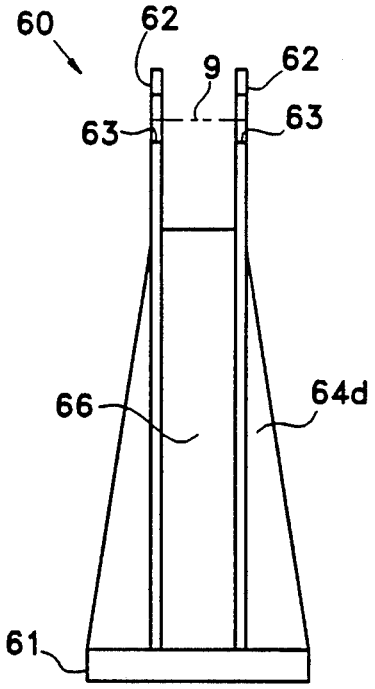

FIGS. 10 and 11 are detail front and plan views of an alternative fulcrum 60.

As shown, the fulcrum 60 includes horizontal base 61 and upright arms 62 having aligned openings 63 into which pivot pin 8 (FIGS. 1 and 13) extends. In this embodiment, the upright arms 62 are also each provided with a pair of transverse legs 64*a*, 64*b* . . . 64*d* to add strength. Transverse to the arms 62 is a gusset 66. Each of legs 64*a* . . . 64*d* are separated by a common distance d. As before, the base 61 is rectangularly shaped and of sufficient dimensions so that it does not sink into wet ground during operations. Note that aligned openings 63 define an axis of rotation 9 perpendicular to the upright arms 62 in the manner previously mentioned.

STUB POST REMOVAL

Figure 12:
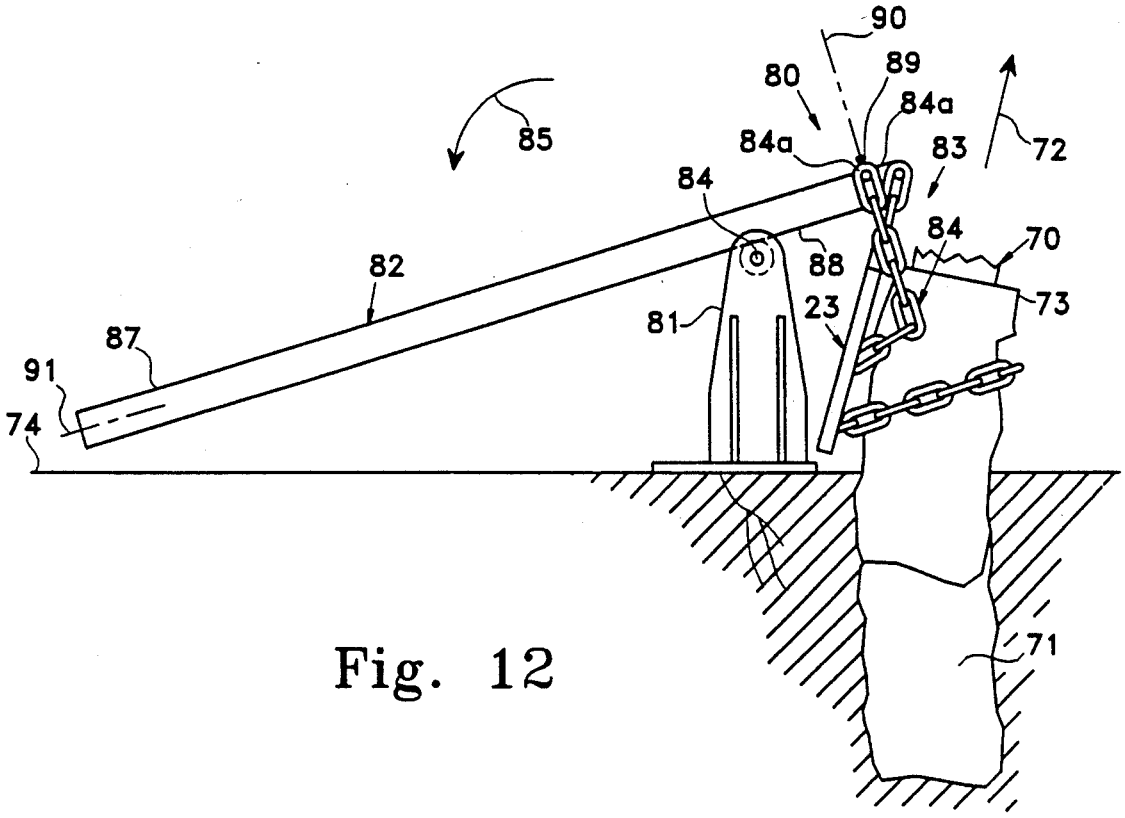
FIG. 12 is a side elevation of a wooden post stub, in partial section, which has undergone extraction using alternate form of the post puller of the invention at the earth's surface in which the fulcrum of the post puller is positioned at the earth's surface adjacent to the extracted post stub with the lever being pivotally attached to the fulcrum and including coupling chain attached to the lever to permit operation in a see-saw manner.

FIG. 12 is a side elevation of wooden post stub 70, in partial section. The stub 70 is undergoing extraction from a hole 71 in the direction of arrow 72. The post stub 70 has an uniform size say of rectangular, square or circular cross section, and has been broken below the earth's surface 74 and a segment (not shown) which is encased within concrete base 73. In this embodiment, the post puller 80 of the invention includes fulcrum 81 positioned at the earth's surface 74, a lever 82 of similar construction, shape and design as previously discussed and coupling means generally indicated at 83. Such coupling means 83 includes a choker chain 84 looped about the concrete base 73. The lever 82 contacts the fulcrum 81 at pivot axis 84. The movement of the lever 82 is from an initial near vertical position to a near horizontal position as shown in FIG. 12 in the direction of arrow 85. Such see-saw motion is transformed into vertical lifting motion to the concrete base 73 via the coupling means 83.

The lever 82 includes a handle 87 that has a fixed length relative to the fulcrum 81 and a lifting segment 88 extending beyond pivot axis 84. The lifting segment 88 comprises a transverse horn member 89 defining an axis of symmetry 90 transverse to axis of symmetry 91 of the lever 82. The horn member 89 extends beyond the circumference of the lifting segment 88 and has sufficient length to permit end links 84*a* of the choker chain 84 to reside about the horn member 89 and remain there by gravity during all arcuate movement of the lever 82. Note that the coupling means 23 (previously described with reference to FIG. 1–3) remains attached to the lever 82 for future operations but is not active as the concrete base 73 is being extracted.

A successful implementation of the invention occurs using the above-described construction, with dimensions and materials as follows:

| |
|---|
| Lever 22 |
| 1½ in. O.D. × ¼ thick. × 4 feet (Sch 80) |
| Carbon steel |
| Coupling Means 23 |
| Chain 41 and Choker chain 84½ inch Grade 80 |

METHOD ASPECTS

In accordance with the method of the invention, the post puller 20 and 80 of the present invention can be used in two separate applications, viz., to extract a post 10, see FIG. 1, that has a length of about 1 foot above the earth's surface 14, and a concrete base 73, see FIG. 12, in which no appreciable length of post to accept coupling means 23 wherein choker chain 84 must be used. In the first instance, the post 10 can be cut by a saw (not shown) to provide the length shown. The method aspects include the following, in brief.

With respect to the application shown in FIG. 1, the steps in accordance with the invention include:

(a) positioning the perforated plate 29 of coupling means 23 over the open end of the post 10 to be extracted and then sliding the plate 29 downwardly to a position adjacent to the earth's surface 14, (b) rotating the lever 22 relative to the fulcrum 21 wherein direct lifting force from the lever 22 to the perforated plate 29 via the pair of chains 36 is applied using link interlock so that easy lifting of the post 10 away from the earth's surface 14 is permitted.

With respect to the application shown in FIG. 12, the steps in accordance with the invention include:

(a) attaching the lever 82 relative to the fulcrum 81 wherein an axis of rotation 84 parallel to the earth's surface 74 is established, (b) looping a choker chain 84 about the concrete base 73 of the post stub 70 and attaching end links 84*a* to a horn mount 89 at the lifting segment 88 of the lever 82, (c) rotating the lever 82 relative to the fulcrum 81 wherein direct lifting force from the lever 82 to the concrete base 73 via the choker chain 84 is applied using link interlock so that easy lifting of the concrete base 73 away from the earth's surface 74 is permitted.

The above description contains several specific embodiments of the invention. It is not intended that such be construed as limitations on the scope of the invention, but merely as examples of preferred embodiments. Persons skilled in the art can envision other obvious possible variations within the scope of the description. Hence the scope of the invention is to be determined by the appended claims and their legal equivalents.

What is claimed is:

1. A post puller for extracting posts of a given cross section from a hole penetrating the earth's surface, comprising a fulcrum having a horizontal base, a pair of upright arms extending from said base and a pivot pin attached between said arms remote from said base;

a lever of circular cross section in pivoting contact with said pivot pin of said fulcrum to establish an axis of rotation substantially parallel to the earth's surface relative to said fulcrum, said lever including a handle of fixed length relative to the fulcrum, a lifting segment, and coupling means connected to lifting segment whereby leverage force of said lever can be applied through said coupling means and hence to a post to be extracted to cause upward movement of said post relative to said earth's surface;

said coupling means including a perforated plate sized to receive the said post and a pair of chains each of at least three links and attached between said perforated plate and said lifting segment, said links including a pair of end links attached to said lifting segment and said perforated plate, respectively and a series of center links interlocked with said end links whereby force applied to said handle of said lever causes said perforated plate and said post to be lifted away from the earth's surface in concert, said end links including a first pair permanently attached to said perforated plate and a second pair permanently attached to said lifting segment of said lever, said perforated plate including a central opening sized to slidably receive said post to be extracted but cantable to disconnectably engage said post, and an insert receivable within said central opening, said insert including a swedge side wall in contact with said central opening and central opening of less area of said central opening to accommodate other sizes of posts.

2. In a post puller for extracting wooden posts of a given cross section from a hole penetrating the earth's surface, the combination comprising a wooden post within a hole penetrating the earth's surface, said post including a concrete base, a fulcrum having a horizontal base seatable on the earth's surface adjacent to said wooden post to be extracted from said hole, upright means extending from said base and including a pivot pin to establish an axis of rotation parallel to the earth's surface, a lever of circular cross section in pivoting contact with said pivot pin of said fulcrum at said axis of rotation, said lever including a handle of fixed length relative to the fulcrum, a lifting segment, and coupling means connected to lifting segment whereby leverage force of said lever can be applied through said coupling means and hence to said wooden post to be extracted to cause upward movement of said post relative to said earth's surface;

said coupling means including a perforated plate sized to receive said post and a pair of chains each of at least three links and attached between said perforated plate and said lifting segment of said lever, said links including a pair of end links attached to said lifting segment and said perforated plate, respectively and a series of center links interlocked with said end links whereby force applied to said handle of said lever causes said perforated plate and said post to be lifted away from the earth's surface in concert, said end links including a first pair that permanently attach to said perforated plate and a second pair that permanently attach to said lifting segment of said lever, said perforated plate including a central opening sized to slidably receive said post to be extracted but cantable to disconnectably engage said post and an insert receivable within said central opening, said insert including a swedge side wall in contact with said central opening and central opening of less area of said central opening to accommodate other sizes of posts.

* * * * *